US006554689B2

(12) United States Patent
Ohkuma et al.

(10) Patent No.: US 6,554,689 B2
(45) Date of Patent: Apr. 29, 2003

(54) WORK HOLDING MEMBER FOR MECHANICAL ABRASION, ABRADING METHOD, AND ABRADING MACHINE

(75) Inventors: Hideo Ohkuma, Shiga-ken (JP); Satoshi Maruyama, Shiga-ken (JP); Kiyoshi Tomiki, Oumihachiman (JP); Makoto Fujikawa, Oumihachiman (JP); Tomohito Johnai, Moriyama (JP); Yutaka Kunii, Ashikaga (JP); Kazuhiko Toyoda, Ashikaga (JP)

(73) Assignees: International Business Machines Corporation, Armonk, NY (US); Hamai Co., Ltd., Tokyo (JP)

( * ) Notice: Subject to any disclaimer, the term of this patent is extended or adjusted under 35 U.S.C. 154(b) by 0 days.

(21) Appl. No.: 10/061,899

(22) Filed: Jan. 31, 2002

(65) Prior Publication Data

US 2002/0102931 A1 Aug. 1, 2002

(30) Foreign Application Priority Data

Jan. 31, 2001 (JP) ..... 2001-024757

(51) Int. Cl.[7] ..... B24B 7/00

(52) U.S. Cl. ..... 451/262; 451/41; 451/54; 451/398

(58) Field of Search ..... 451/262, 261, 451/263, 264, 265, 266, 267, 268, 269, 132, 302, 190, 191, 192, 194, 41, 54, 63, 379, 397, 398

(56) References Cited

U.S. PATENT DOCUMENTS

| | | | | | |
|---|---|---|---|---|---|
| 3,924,356 | A | * | 12/1975 | Kitchel | 451/113 |
| 4,621,458 | A | * | 11/1986 | Smith | 451/262 |
| 4,685,845 | A | * | 8/1987 | Emter | 409/145 |
| 4,730,420 | A | * | 3/1988 | Stratmann et al. | 269/258 |
| 5,941,759 | A | * | 8/1999 | Kitajima et al. | 438/692 |
| 5,993,291 | A | * | 11/1999 | Tsai et al. | 451/28 |
| 6,089,959 | A | * | 7/2000 | Nagahashi | 451/262 |
| 6,113,467 | A | * | 9/2000 | Koike | 451/262 |
| 6,231,428 | B1 | * | 5/2001 | Maloney et al. | 451/287 |
| 6,361,418 | B1 | * | 3/2002 | Inada | 451/262 |

* cited by examiner

*Primary Examiner*—Eileen P. Morgan
*Assistant Examiner*—Hadi Shakeri
(74) *Attorney, Agent, or Firm*—Jay H. Anderson

(57) ABSTRACT

An abrading machine and abrading method are provided which permit a workpiece to be abraded without damage even in the case of heavy stock removal. A work holding member for mechanical abrasion includes a first holding member with a hole for receiving a workpiece and which transmits external drive force to the workpiece, and a second holding member placed on the first holding member and also having a hole for receiving the workpiece. The second holding member is removed after a predetermined volume of stock is abraded away; the workpiece is then abraded to a target thickness while being held by the first holding member alone. Thicknesses t1 and t2 of the first and second holding members are given by T1>t1+t2 and (½)T2≦t1, where T1 and T2 represent the workpiece thickness before and after abrasion, respectively.

11 Claims, 6 Drawing Sheets

WORK HOLDING MEMBER FOR MECHANICAL ABRASION, ABRADING METHOD, AND ABRADING MACHINE

FIELD OF THE INVENTION

The present invention relates to an abrading method and abrading machine suitable for abrading liquid crystal cells for liquid crystal displays.

BACKGROUND OF THE INVENTION

In recent years, rectangular thin glass substrates 0.5 mm to 1.5 mm thick have been used for flat displays such as liquid crystal displays. Precise flatness is required of these substrates. Glass substrates molded by standard industrial processes contain minute surface imperfections, waviness and irregularities. Such substrates are not flat enough to be used in flat displays without further processing. Generally, therefore, the surfaces of molded glass substrates are abraded to a desired flatness on an abrading machine.

In a liquid crystal display, a liquid crystal material is encapsulated between a pair of glass substrates forming a liquid crystal cell. One of the glass substrates is a color filter substrate while the other is a TFT (Thin Film Transistor) array substrate. Liquid crystal cells tend to become increasingly thin as the weight of liquid crystal displays is reduced. In order to obtain a thin liquid crystal cell, the liquid crystal cell is typically abraded by using a double-sided abrading machine until the color filter substrate and the TFT array substrate are laminated, that is, abraded to a desired thickness after forming the liquid crystal cell.

A conventional double-sided abrading machine will be described below with reference to FIGS. 4, 5A and 5B. FIG. 4 is a side view of a conventional double-sided abrading machine. FIGS. 5A and 5B show a work carrier used in a conventional double-sided abrading machine, FIG. 5A is a plan view of the work carrier, and FIG. 5B is a sectional view taken along line A—A in FIG. 5A. FIG. 4 also shows an abrasion process in which a liquid crystal cell 6 as a workpiece is being abraded by using two work carriers of the type shown in FIG. 5.

The double-sided abrading machine 100 shown in FIG. 4 includes an upper plate 4 and a vertically opposed lower plate 5, as well as a carrier 101 serving as a holding member placed between the upper plate 4 and the lower plate 5.

A shaft 16 is secured to the upper plate 4 and a shaft 17 is secured similarly to the lower plate 5. The shaft 16 and the shaft 17 are rotated by a drive means (not shown) to rotate the upper plate 4 and the lower plate 5.

As shown in FIGS. 5A and 5B, a holding hole 101*a* is formed in the carrier 101 to fit the outer shape of the liquid crystal cell 6, which is inserted and held in holding hole 101*a*. The hole is slightly larger the liquid crystal cell 6 to make it easy to insert liquid crystal cell 6. The liquid crystal cell has a TFT array substrate 61 and a color filter substrate 62 stacked together, above and below a thin liquid crystal layer (not shown). The color filter substrate 62 has a surface area slightly smaller than that of the TFT array.

The double-sided abrading machine 100 has a small-diameter sun gear 7 inside the perimeter of the upper plate 4 and lower plate 5, and a large-diameter internal gear 8 around the perimeter. The sun gear 7 is secured to a drive shaft (not shown) which passes through the lower plate 5. Gear 7 rotates coaxially with the shaft 17 as the drive shaft rotates. The internal gear 8 is mounted outside the upper plate 4 and lower plate 5 and driven coaxially with the shaft 17 by a drive source (not shown).

The carrier 101 has a gear formed along its circumference, as shown in FIG. 5A. This gear is positioned so as to mesh with the sun gear 7 and internal gear 8. Therefore, since it is held between the rotating upper plate 4 and lower plate 5 and meshed with the sun gear 7 and internal gear 8, the carrier 101 revolves around the sun gear 7 while rotating on its axis. The front and rear faces of the liquid crystal cell 6, held by the carrier 101 and pressed by the upper plate 4 and lower plate 5, are abraded while an abrasive is supplied automatically between the upper plate 4 and lower plate 5.

In a conventional arrangement, a workpiece is held by a single carrier throughout the entire process of mechanical abrasion. Consequently, when a large volume of stock is removed, the clearance between the upper plate and carrier (that is, the range of the carrier's vertical displacement) increases, making the workpiece prone to breakage and the like, as detailed below.

The thickness of the carrier 101 must be smaller than the target thickness of the workpiece (that is, the liquid crystal cell 6) after mechanical abrasion. Otherwise, the upper plate 4 and lower plate 5, between which the carrier 101 is placed to receive and hold the liquid crystal cell 6, cannot come into contact with the liquid crystal cell 6, which in turn makes it impossible to grind the liquid crystal cell 6. Consequently, a problem arises if a large volume of stock is to be removed, as is the case with a liquid crystal cell including laminated substrates; for example, the TFT array substrate 61 and the color filter substrate 62 with a smaller surface area than the TFT array (see FIG. 4). Specifically, with such a workpiece, there is a large clearance L between the upper plate 4 and carrier 101 in an early stage of mechanical abrasion. This may cause carrier 101 to contact an exposed portion of the top surface of TFT array substrate 61, resulting in chips, cracks, or other damage to the liquid crystal cell 6. Damage is noticeable especially when the liquid crystal cell 6 is abraded on the conventional double-sided abrading machine 100 compared to other types of workpieces.

FIG. 6 shows how the liquid crystal cell 6 is abraded on the conventional double-sided abrading machine 100. As shown in FIG. 6, the liquid crystal cell 6 consists of the TFT array substrate 61 and color filter substrate 62. Normally, the TFT array substrate 61 and color filter substrate 62 have the same thickness, but the TFT array substrate 61 generally has a larger surface area than the color filter substrate 62 to secure space for electrode wires. Therefore, a step is formed around the liquid crystal cell 6. If the liquid crystal cell 6 with such a step is abraded on the conventional double-sided abrading machine 100, it is often the case not only that the carrier 101 is displaced vertically during mechanical abrasion as shown in FIG. 6A, but also that the carrier 101 contacts the step around the liquid crystal cell 6 as shown in FIG. 6B, resulting in breakage of the carrier 101. If the thickness of the carrier 101 is increased these problems will not arise, but the desired stock removal then cannot be performed.

SUMMARY OF THE INVENTION

It is an object of the present invention to provide an abrading method and abrading machine which will allow a workpiece to be abraded without damage even in the case of heavy stock removal. This is done by stacking a plurality of carriers for holding the workpiece, so that the carrier height may be varied according to the stage of mechanical abrasion. In this way, the vertical displacement of the carriers can be restricted and breakage of workpieces caused by carriers can be avoided, even in the case of heavy stock removal, as long as the clearance between the upper plate and carriers is kept within a designated range.

In accordance with a first aspect of the present invention, a work holding member for mechanical abrasion is provided, comprising a first holding member which has a socket for receiving a workpiece and transmits external drive force to the workpiece, and a second holding member which is placed on the first holding member and has a socket for receiving the workpiece.

Since the work holding member for mechanical abrasion according to the present invention includes a first holding member and second holding member, the workpiece can be held by the first holding member alone (by taking away the second holding member), depending on the abraded quantity. Specifically, the workpiece can be held by the first and second holding members in an early stage of mechanical abrasion, while in the last stage of mechanical abrasion the workpiece can be abraded to a target thickness using only the first holding member. This makes it possible to restrict vertical displacement of the work holding member for mechanical abrasion even in the case of heavy stock removal.

Since the first holding member according to the present invention has the function of transmitting external drive force, it corresponds to the carrier 101 described above. On the other hand, the second holding member has the function of a spacer which limits the clearance between the upper plate and carriers to a designated value. The second holding member does not need to have the function of transmitting the external drive force to the workpiece. Alternatively, the external drive force may be transmitted to the workpiece through the second holding member. As another alternative, additional holding members may be used.

If the workpiece is a laminate of two plates such as a liquid crystal cell, the color filter substrate and TFT array substrate are generally equal in thickness and thus the color filter substrate and TFT array substrate are abraded from above and below, respectively, by an equal amount on a double-sided abrading machine. Consequently, the target thickness of the liquid crystal cell as a whole after mechanical abrasion is twice the target thickness of the color filter substrate or TFT array substrate after mechanical abrasion. In this way, when the workpiece is a laminate of two plates, the thickness of the first holding member should be equal to or larger than the target thickness of a single plate (either the color filter substrate or TFT array substrate in the case of a liquid crystal cell) after mechanical abrasion. Incidentally, although there is a liquid crystal layer between the color filter substrate and TFT array substrate, its thickness is negligible compared to the thicknesses of the color filter substrate and TFT array substrate. Accordingly, the liquid crystal layer is ignored herein.

In the work holding member for mechanical abrasion according the present invention, if the thicknesses of the workpiece before and after mechanical abrasion are denoted by T1 and T2, respectively, and the thicknesses of the first holding member and second holding member are denoted by t1 and t2, respectively, the following relations should be satisfied:

$$T1>t1+t2$$

$$(1/2)T2\leqq t1$$

Furthermore, in the work holding member for mechanical abrasion according the present invention, if a workpiece having two laminated substrates equal in thickness (such as a liquid crystal cell) is abraded, the thicknesses of the first holding member and second holding can be determined as follows. If the thicknesses of the workpiece before and after mechanical abrasion are denoted by T1 and T2, respectively, and the thicknesses of the first holding member and second holding member are denoted by t1 and t2, respectively, the following relations should be satisfied:

$$T1>t1+t2>T2$$

$$(1/2)T1\geqq t1>(1/2)T2$$

$$T2>t1$$

According to a second aspect of the present invention, an abrading method is provided which includes placing a workpiece, held by a holding member, between a pair of upper and lower plates and abrading the workpiece by rotating the pair of plates and the holding member. This method includes the following steps: a first abrading step of abrading the workpiece held by first and second holding members disposed in the direction of the thickness of the workpiece, removing the first or second holding member after a predetermined quantity is abraded from the workpiece, and a second abrading step of further abrading the workpiece.

The abrading method of the present invention grinds the workpiece using the first and second holding members until the volume of material removed reaches a designated value. Therefore, the clearance between the holding members and upper plate can be reduced even if a large volume of stock is to be removed. Moreover, since the first or second holding member is taken away as the workpiece becomes thin, subsequent abrading operations are not hindered. Thus, according to the abrading method of the present invention, whether the volume of stock removed from the workpiece has reached a designated value can be judged based on the clearance between the first or second holding member which is not removed in the second abrading step and the upper plate.

In addition, according to the abrading method of the present invention, the workpiece may have a step around the perimeter thereof and the first abrading process may be performed with either the first or second holding member mounted on the step. Workpieces with such a step include liquid crystal cells.

As described above, the second holding member of the work holding member for mechanical abrasion according to the present invention functions as a spacer, and has the function of restricting vertical displacement of the first holding member (the first holding member corresponding in this case to a conventional carrier). Therefore, according to another aspect of the present invention, an abrading method is provided which includes placing a workpiece, held by a work carrier, between a pair of upper and lower plates and abrading the workpiece by rotating the pair of plates and the work carrier. This method comprises a first abrading step of abrading the workpiece by restricting vertical displacement of the work carrier; a step of lifting this restriction on the vertical displacement of the work carrier after a predetermined quantity is abraded from the workpiece, and a second abrading step of further abrading the workpiece.

In the abrading method of the present invention, it is desirable that in the second abrading step, the clearance between the work carrier and upper plate should be equal to or less than the thickness of the work carrier.

According to a further aspect of the present invention, an apparatus is provided for performing the abrading method of the present invention. Specifically, an abrading machine according to the present invention includes a lower plate for mounting a workpiece; an upper plate disposed opposite the lower plate, a holding member for holding a workpiece disposed between the lower plate and the upper plate and providing driving force to the workpiece; and a spacer disposed between the holding member and the upper plate and driven along with the workpiece. The abrading machine of the present invention makes it possible to grind a workpiece to a target thickness, keeping the clearance between the upper plate and carriers within a designated range even in the case of heavy stock removal.

BRIEF DESCRIPTION OF THE DRAWINGS

FIG. 2A is a plan view and FIG. 2B is a sectional view taken along a line X—X in FIG. 2A.

FIG. 5A is a plan view and FIG. 5B is a sectional view taken along a line A—A in FIG. 5A.

DETAILED DESCRIPTION OF A PREFERRED EMBODIMENT

A work holding member for mechanical abrasion according to an embodiment of the present invention, as well as an abrading machine and abrading method using such machine will be described below with reference to the drawings. In this embodiment, a liquid crystal cell is used as a workpiece.

Figure 1:
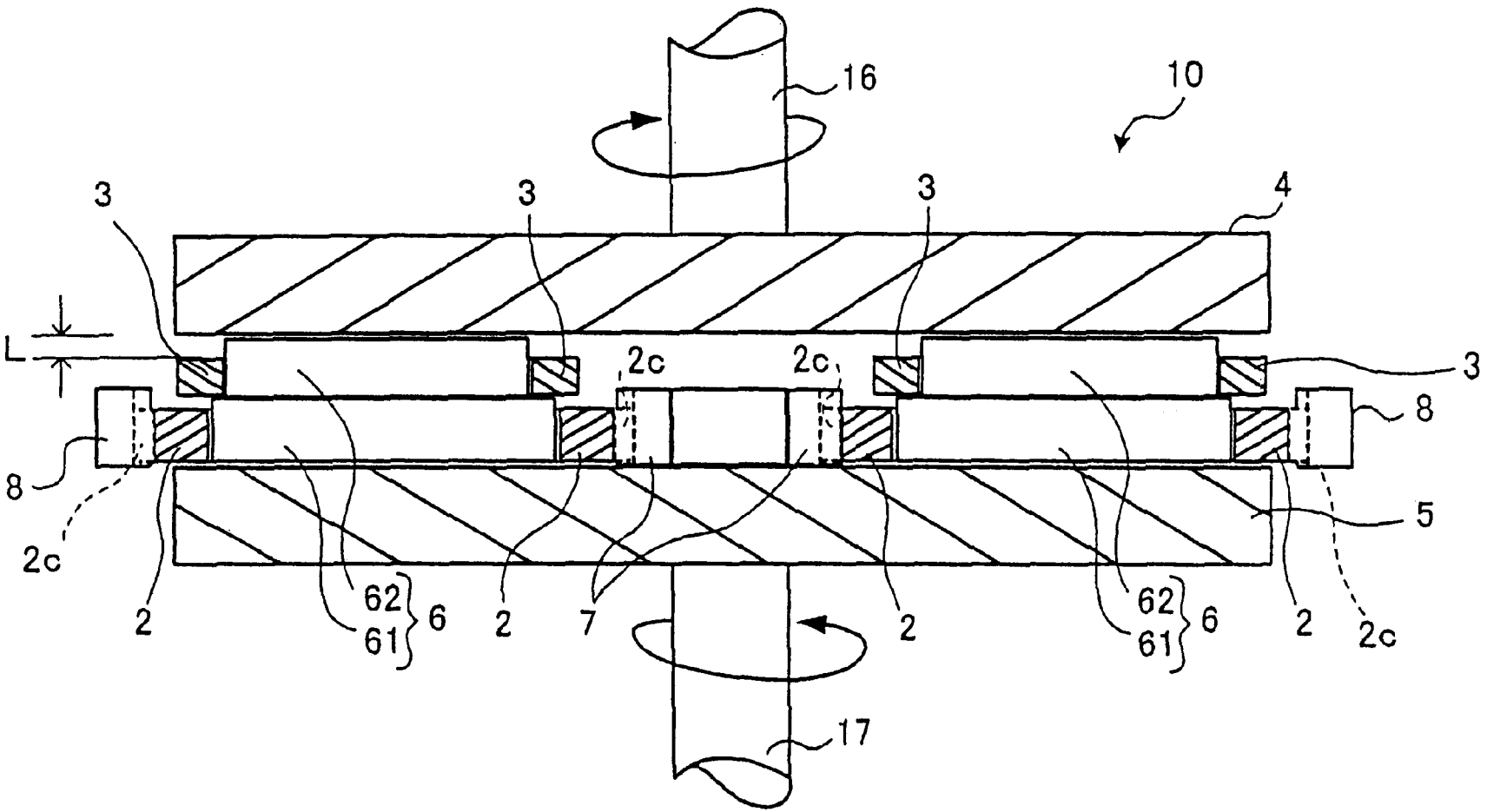
FIG. 1 is a side view of an abrading machine according to an embodiment of the present invention.
Figure 2:
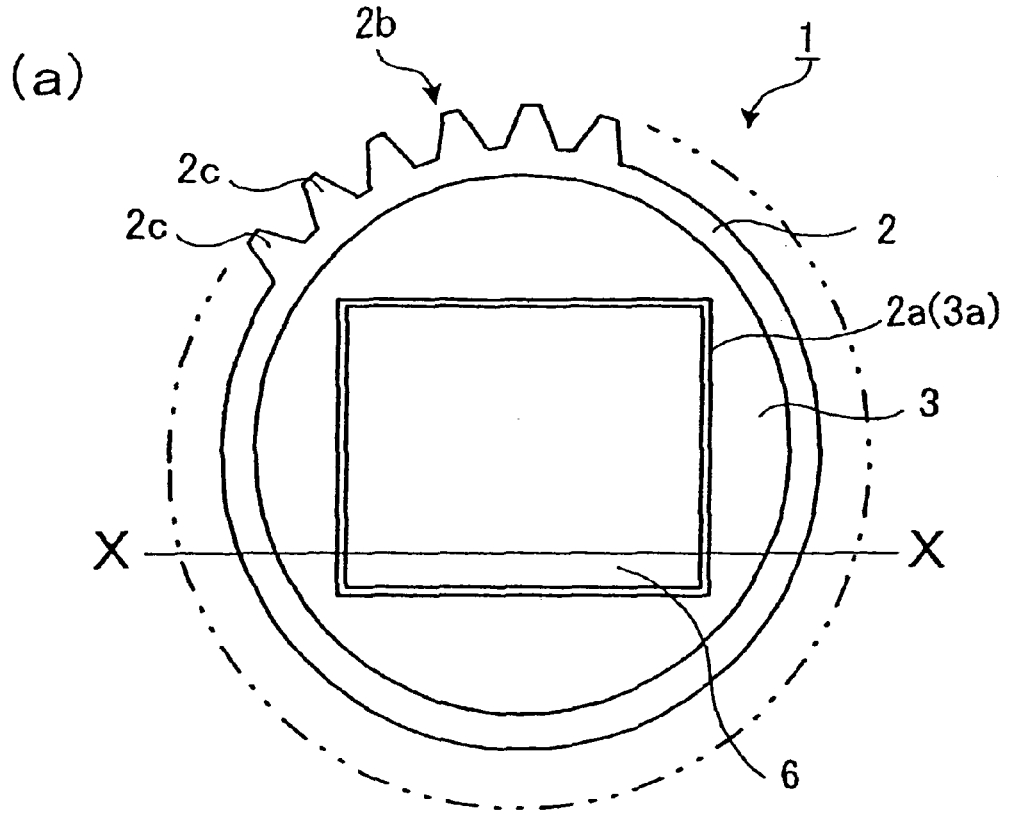
FIGS. 2A and 2B illustrate a stack carrier according to this embodiment, where
Figure 2:
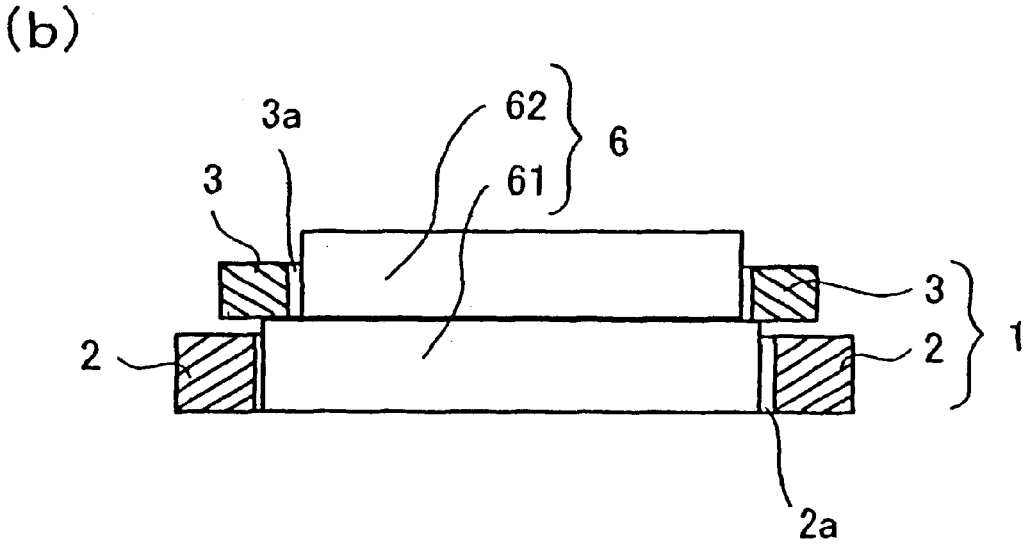
Figure 4:
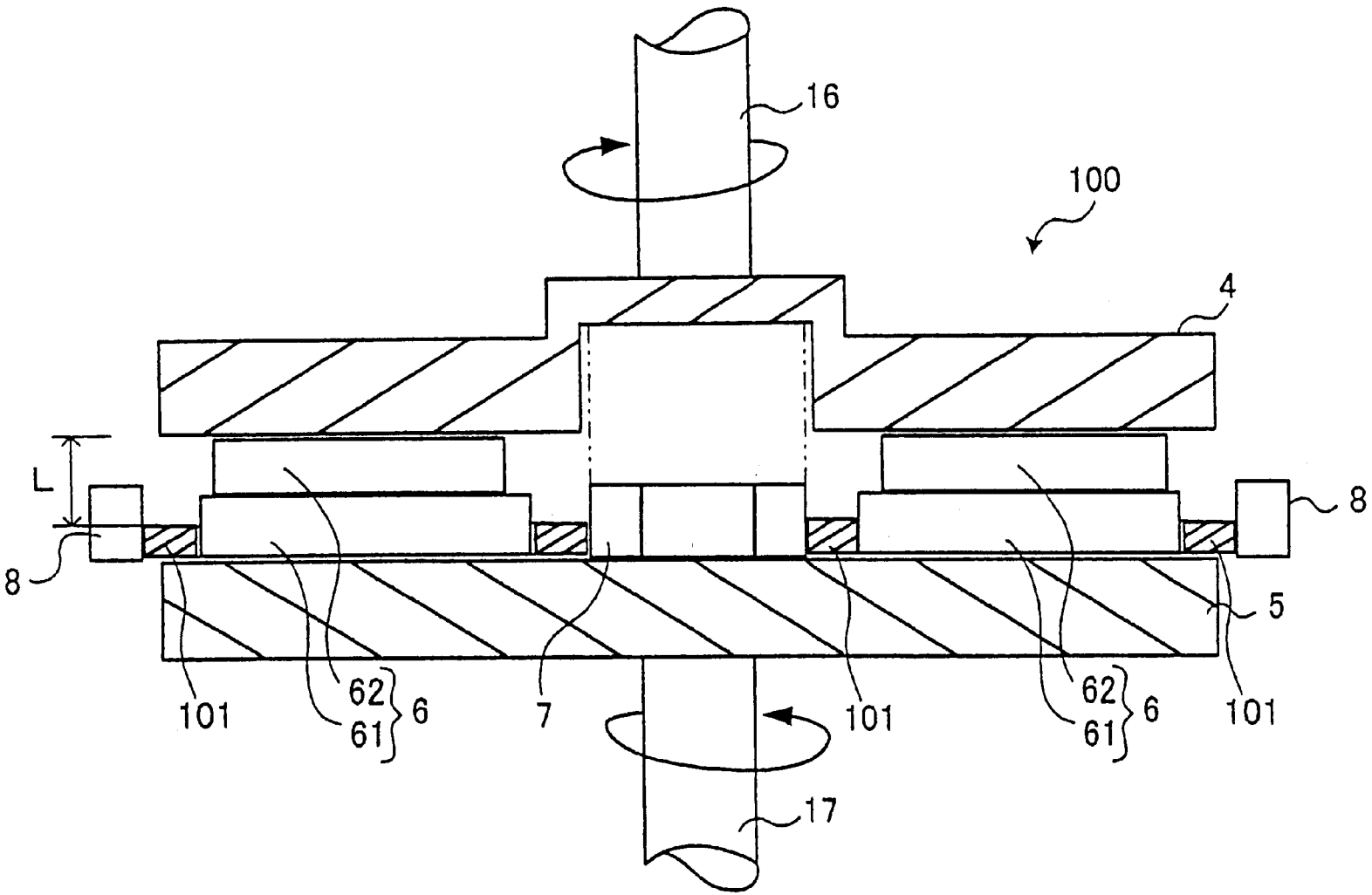
FIG. 4 is a side view of a conventional double-sided abrading machine.
Figure 5:
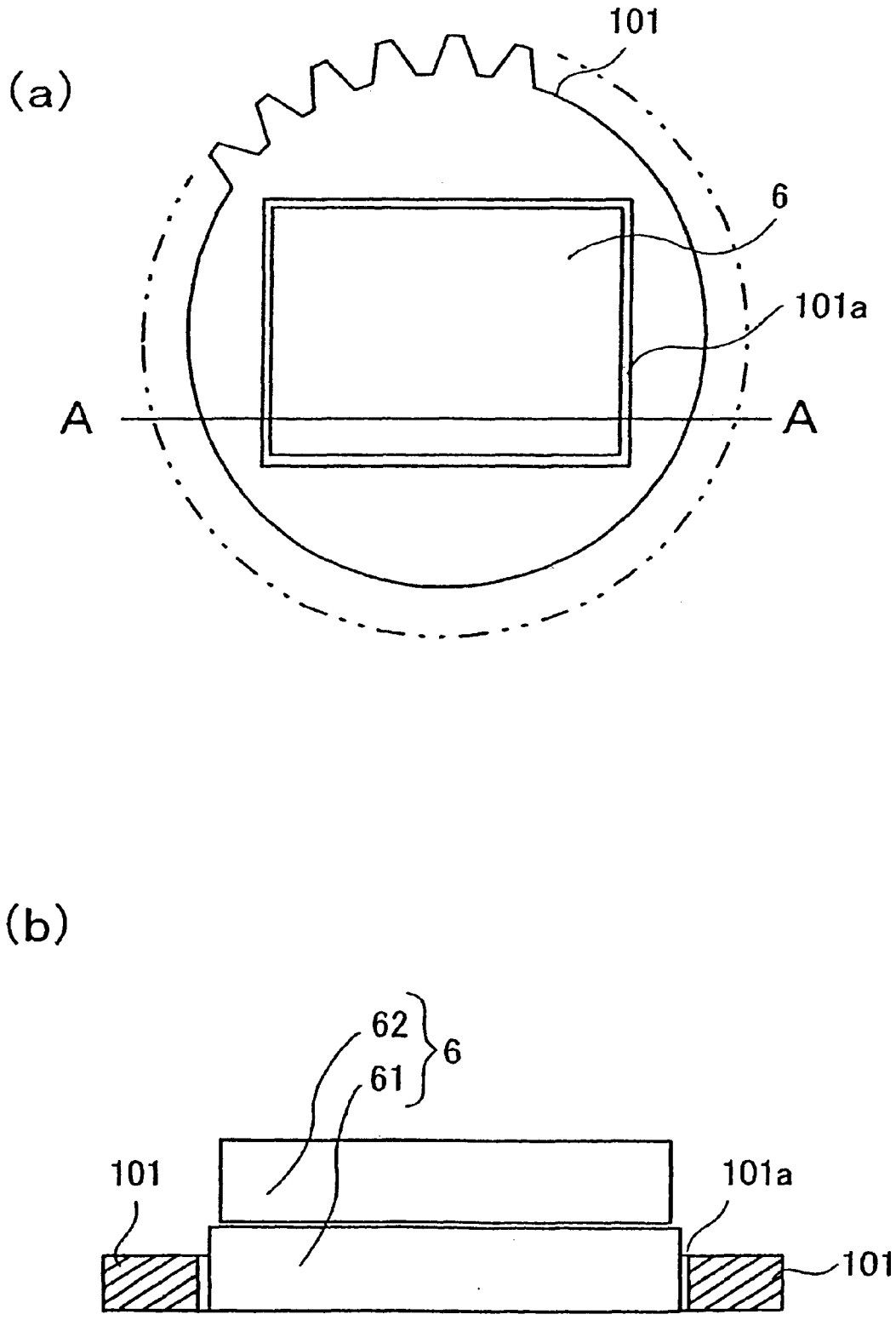
FIGS. 5A and 5B illustrate a conventional work carrier, where
Figure 6:
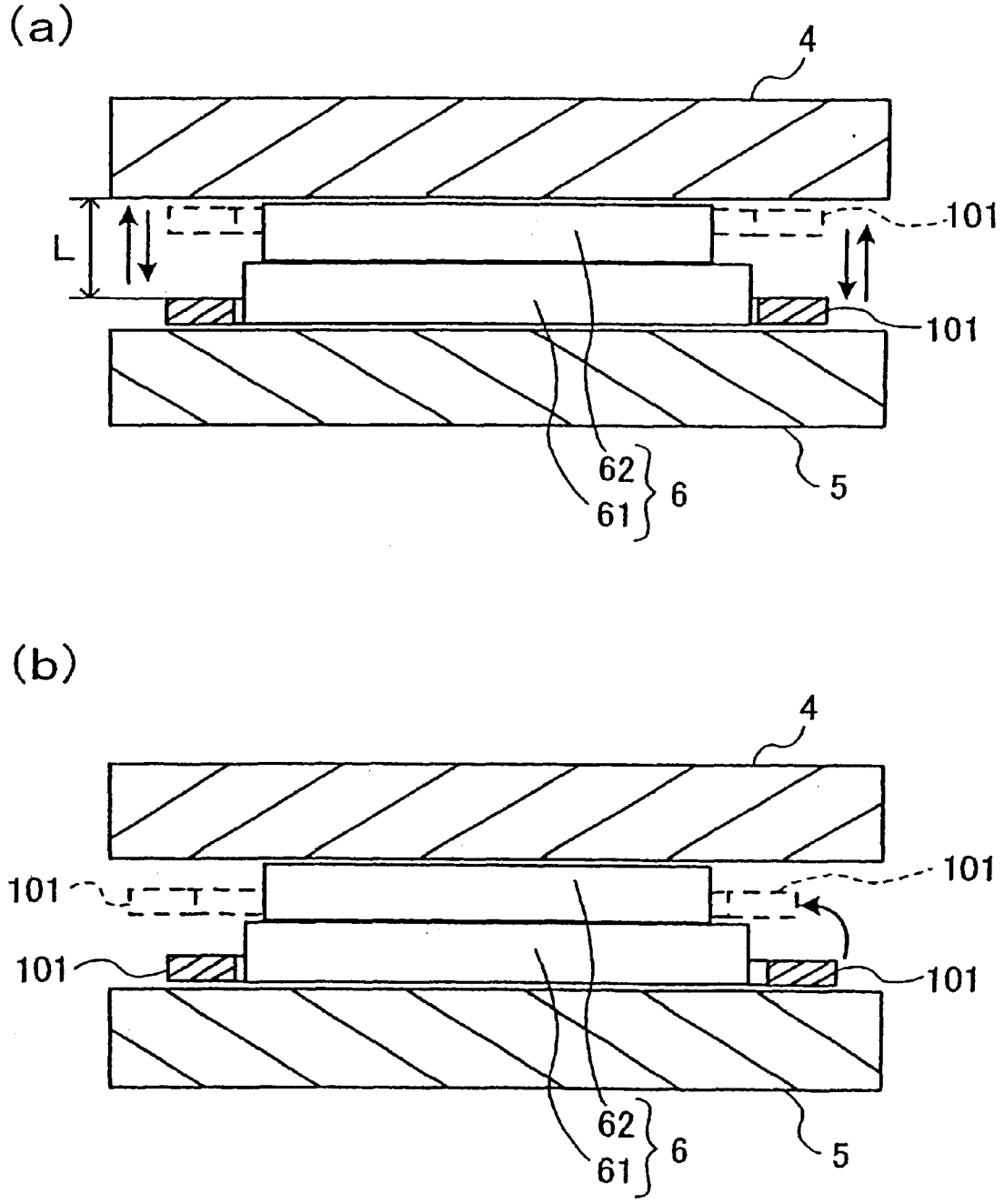
FIGS. 6A and 6B illustrate how a liquid crystal cell is abraded on a conventional double-sided abrading machine.

FIG. 1 is a side view of an abrading machine 10 using a work holding member for mechanical abrasion 1 according to this embodiment. FIG. 2 illustrates the work holding member for mechanical abrasion 1 according to this embodiment, where FIG. 2A is a plan view and FIG. 2B is a sectional view taken along a line X—X in FIG. 2A. Incidentally, the same components as those of the conventional abrading machine shown in FIGS. 4 to 6 are denoted by the same reference characters as those in FIGS. 4 to 6.

First, a description will be given of the configuration of the abrading machine 10 using the work holding member for mechanical abrasion 1 according to this embodiment.

The work holding member for mechanical abrasion 1 includes a first holding member 2 and a second holding member 3 placed on the first holding member 2. The work holding for mechanical abrasion 1 is placed between a vertically opposed upper plate 4 and lower plate 5, as shown in FIG. 1. Grid-like, spiral grooves are formed in the opposing faces of the upper plate 4 and lower plate 5 (mainly intended for lapping).

As shown in FIG. 1, a shaft 16 is secured to the upper plate 4 and a shaft 17 is secured similarly to the lower plate 5. The shaft 16 and shaft 17 are rotated by drive means (not shown) to rotate the upper plate 4 and lower plate 5.

A small-diameter sun gear 7 is provided inside the perimeter of the lower plate 5 and a large-diameter internal gear 8 is provided on the same rotational axis. The first holding member 2 is positioned between the sun gear 7 and internal gear 8 so that an external gear 2*b* around the circumference of the first holding member 2 will mesh with the sun gear 7 and internal gear 8. Therefore, between the internal gear 8 installed around the circumference of the machine and the sun gear 7 installed at the center of the apparatus, the first holding member 2 revolves around the sun gear 7 while rotating on its axis during mechanical abrasion along with the rotation of the upper plate 4 and lower plate 5. In this way, by the revolution and rotation of the first holding member 2 which receives and holds a liquid crystal cell 6, both faces of the liquid crystal cell 6 can be abraded uniformly. The first holding member 2 has the function of holding the liquid crystal cell 6 being abraded as well as transmitting to it an external drive force. Thus, the first holding member 2 functions as the carrier 101 described above.

The front and rear faces of the liquid crystal cell 6, held by the work holding member for mechanical abrasion 1 and pressed by the upper plate 4 and lower plate 5, are abraded by revolution and rotation of the first holding member 2 while an abrasive is supplied automatically between the upper plate 4 and lower plate 5. A mixture of fine abrasive particles such as alumina ($Al_2O_3$), silicon carbide (SiC), and silica ($SiO_2$) is used as the abrasive.

As shown in FIG. 2A, a holding hole 2*a* is formed in the first holding member 2 to receive and hold the liquid crystal cell 6. The liquid crystal cell 6 is inserted and held in this holding hole 2*a*. The holding hole 2*a* has a rectangular shape corresponding with the liquid crystal cell 6. If the workpiece is circular, as is the case with a Si wafer, the holding hole 2*a* is likewise shaped into a circular form. The size of the holding hole 2*a* is determined such that the liquid crystal cell 6 can be inserted easily and will be held securely during mechanical abrasion. Although one holding hole 2*a* is provided according to this embodiment, it is also possible, to provide two or more holding holes 2*a*. If two or more holding holes 2*a* are provided, two or more liquid crystal cells 6 can be abraded with a single holding member. Also, as shown in FIG. 2A, the first holding member 2 has the external gear 2*b* consisting of a plurality of teeth 2*c* formed on its circumference. Some rigidity is required of the first holding member 2, which performs the function of transmitting the external drive force. It may be formed, for example, of glass fiber-reinforced epoxy resin with the addition of aramid (aromatic polyamide), phenol resin or other resins, steel, etc., depending on the material of the workpiece.

As shown in FIG. 2A, a holding hole 3*a* is also formed in the second holding member 3 to receive and hold the liquid crystal cell 6, as is the case with the first holding member 2.

As shown in FIG. 2B, the inner circumference of the second holding member 3 contacts a step around the circumference of the liquid crystal cell 6. Therefore, the second holding member 3 is rotated together with the liquid crystal cell 6, which in turn is driven along with the rotation of the first holding member 2. In this way, the second holding member 3 differs from the first holding member 2 in that it is not driven by an external drive force. Since it does not receive an external drive force, the second holding member 3 does not need a gear around it, unlike the first holding member 2. Consequently, the second holding member 3 need not be as rigid as the first holding member 2, and it is desirable to make the second holding member 3 only from materials that will not damage the liquid crystal cell 6.

A description will now be given of the thicknesses (heights) of the first holding member 2 and second holding member 3 which comprise the work holding member for mechanical abrasion according to the present invention.

Based on the thicknesses T1 and T2 of the liquid crystal cell 6 before and after mechanical abrasion, the respective thicknesses t1 and t2 of the first holding member 2 and second holding member 3 are determined as follows:

$$T1>t1+t2 \quad (1)$$

$$(½)T2 \leqq t1 \quad (2)$$

If the sum of the thicknesses t1 and t2 of the first holding member 2 and second holding member 3 (that is, the thickness of the work holding member for mechanical abrasion 1) is not less than the thickness T1 of the liquid crystal cell 6 before mechanical abrasion, the upper plate 4 and lower plate 5 cannot come into contact with the liquid crystal cell 6 and proceed to abrade and reduce the thickness of the liquid crystal cell. Therefore, T1>t1+t2 in Equation (1) must be satisfied.

In this embodiment, the thickness of the work holding member for mechanical abrasion 1 is varied according to the stage of mechanical abrasion. That is, the second holding member 3 is removed during mechanical abrasion, and thereafter the liquid crystal cell 6 is held by only the first holding member 2 and is simultaneously abraded. In so doing, by making the thickness t1 of the first holding member 2 equal to or larger than ½the target thickness T2 of the liquid crystal cell 6 after mechanical abrasion as shown in Equation (2), it is possible to prevent the first holding member 2 from contacting the step around the liquid crystal cell 6. This will be described later.

Generally, the color filter substrate 62 and TFT array substrate 61 in the liquid crystal cell 6 are equal in thickness and are abraded by equal amounts on a double-sided abrading machine. Thus, Equation (2) can be expressed as "the thickness t1 of the first holding member ≦ the target thickness of the color filter substrate 62 or TFT array substrate 61 after mechanical abrasion." Specifically, when a workpiece having two laminated substrates approximately equal in thickness is abraded, the thicknesses t1 and t2 of the first holding member 2 and second holding member 3 can be determined as follows, based on the thicknesses T1 and T2 of the liquid crystal cell 6 before and after mechanical abrasion:

$$T1>t1+t2>T2 \quad (3)$$

$$(½)T1 \geqq t1>(½)T2 \quad (4)$$

$$T2>t1 \quad (5)$$

By setting the thicknesses of the first holding member 2 and second holding member 3 so that Equations (1) to (2) or (3) to (5) are satisfied, it is possible to (i) make the range of vertical displacement of work holding member 1 smaller than in conventional arrangements (even in the case of heavy stock removal), and (ii) prevent the first holding member 2 from contacting the step around the liquid crystal cell 6. This in turn makes it possible to avoid damage to the color filter substrate 62 and TFT array substrate 61 in liquid crystal cell 6.

Figure 3:
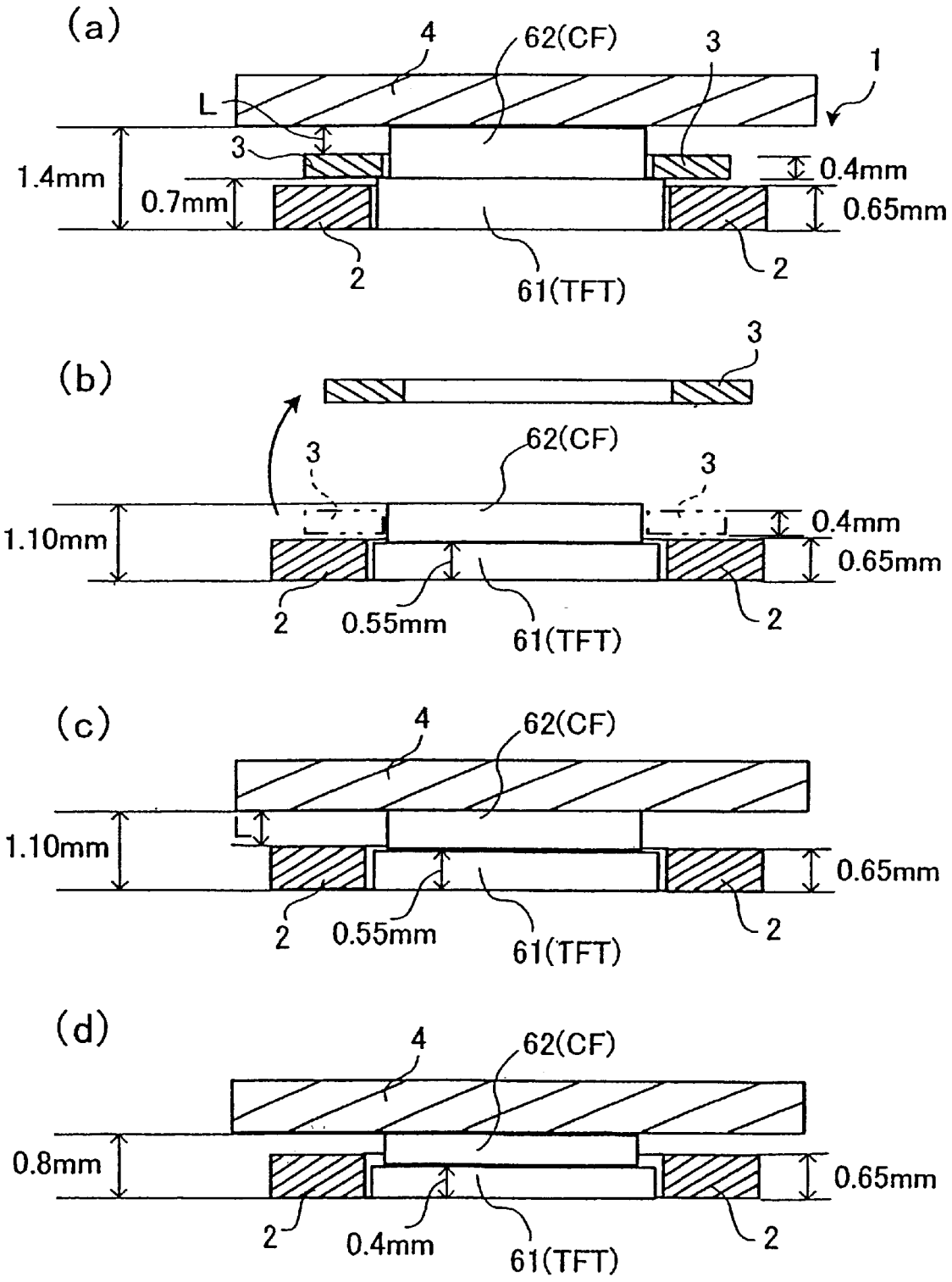
FIGS. 3A, 3B, 3C and 3D illustrate an abrading method according to the present invention.

An abrading method in accordance with the present invention will now be described more specifically with reference to FIGS. 1 to 3.

This embodiment will be described taking as an example a case in which a workpiece, specifically a 1.4-mm thick (before mechanical abrasion) liquid crystal cell 6 including a laminated TFT array substrate 61 and color filter substrate 62 (each 0.7 mm thick), is abraded to a thickness of 0.8 mm (target thickness after mechanical abrasion).

To abrade the 1.4-mm thick liquid crystal cell to a thickness of 0.8 mm, the thickness of the second holding member 3 is set at 0.4 mm and the thickness of the first holding member 2 is set at 0.65 mm based on Equation (1) above. This means that the thickness of the work holding member for mechanical abrasion 1 is 1.05 mm. Two work holding members for mechanical abrasion 1 are placed between the upper plate 4 and lower plate 5 in this example, but it is also possible to use either one or more than two work holding members for mechanical abrasion.

As shown in FIG. 1, the first holding members 2 are positioned on the lower plate 5 such that the external gears 2*b* on the circumference will mesh with the sun gear 7 and internal gear 8. The liquid crystal cells 6 are inserted in the holding holes 2*a* of the first holding members 2. The second holding members 3 are then mounted on the first holding members 2 as well as on the exposed portions of TFT array substrates 61 around the perimeter of the liquid crystal cells 6 supported by the first holding members 2. The work holding member for mechanical abrasion 1 thus includes the first holding member 2 and the second holding member 3 mounted on the first holding member 2 (see FIG. 3A). At this time, clearance L between the work holding member for mechanical abrasion 1 and the upper plate 4 is approximately 0.3 mm. Specifically, when the second holding member 3 is on the step around the liquid crystal cell 6, the clearance L approximately equals the thickness of the color filter substrate 62 minus the thickness of the second holding member 3 (0.7 mm−0.4 mm=0.3 mm). On the other hand, when the second holding member 3 is in contact with the first holding member 2, the clearance L approximately equals the thickness of the liquid crystal cell 6 minus the thickness of the work holding member for mechanical abrasion 1 (that is, the thickness of the first holding member 2 plus the thickness of the second holding member 3: 1.4 mm−1.05 mm=0.35 mm).

The upper plate 4 and lower plate 5 are rotated with the upper plate 4 kept in contact with the liquid crystal cells 6. Meanwhile, the internal gear 8 rotates along with the rotation of the lower plate 5 and the sun gear 7 is driven by a driving source (not shown), causing the first holding members 2, meshed with the sun gear 7 and internal gear 8, to revolve around the sun gear 7 while rotating on their own axes. As the first holding members 2 revolve and rotate, both top and bottom faces of the liquid crystal cells 6, which are held by the first holding members 2, are abraded. As described above, both faces of the liquid crystal cells 6, held by the work holding members for mechanical abrasion 1 and pressed by the upper plate 4 and lower plate 5, are abraded while an abrasive is supplied automatically between the upper plate 4 and lower plate 5.

During this abrading process, the first holding members 2 have their vertical displacement restricted by the second holding members 3. Since the clearance L is not more than 0.35 mm, the second holding members 3 themselves are not greatly displaced. Therefore, there is little possibility that the liquid crystal cells 6 will be damaged.

When the liquid crystal cells 6 are abraded to a thickness of 1.10 mm, the second holding members 3 are taken away (see FIGS. 3B and 3C). The clearance L between the upper plate 4 and the first holding member 2 is then 0.45 mm (see FIG. 3C).

Since both top and bottom faces of the liquid crystal cells 6 are abraded by equal amounts, when the liquid crystal cells 6 are 1.10 mm thick, both color filter substrates 62 and TFT array substrates 61 are 0.55 mm thick. According to this embodiment, the clearance L is at its maximum immediately after the second holding members 3 are taken away. Even at this point, the thickness (0.65 mm) of the first holding members 2 is larger than the thickness (0.55 mm) of the color filter substrates 62, which in turn is larger than the clearance L (0.45 mm). Therefore, the first holding members do not contact the steps around the liquid crystal cells 6.

After the second holding members 3 are taken away, the liquid crystal cells 6, held by the first holding members 2 alone, are abraded to the target thickness of 0.8 mm (see FIG. 3D). During this abrading process, if the clearance L exceeds the thickness of the first holding members 2, the first holding members 2 may contact the steps around the liquid crystal cells 6. However, by setting the thickness of the first holding members 2 such that Equation (2) will be satisfied, it is possible to always maintain the relation "thickness of the first holding member ≧ clearance L." This prevents the first holding members from contacting the steps around the liquid crystal cells 6.

In this way, by using both second holding member 3 and first holding member 2 in an early stage of mechanical abrasion, the clearance L between the work holding member for mechanical abrasion 1 and the upper plate 4 can be decreased, even in the case of heavy stock removal. According to this embodiment, when abrading the 1.4-mm thick (before mechanical abrasion) liquid crystal cells by 0.6 mm to a thickness of 0.8 mm (target thickness after mechanical abrasion), the clearance L between the carriers and the upper plate 4 can be maintained in the range of about 0.3 mm to 0.45 mm.

In this embodiment, the 0.4-mm thick second holding member 3 and 0.65-mm thick first holding member 2 have been used to abrade the 1.4-mm thick (before mechanical abrasion) liquid crystal cell 6 to a thickness of 0.8 mm (target thickness after mechanical abrasion), but other thickness values may be used as long as Equation (1) above is satisfied. For example, the thickness of the second holding member 3 may be set at 0.2 mm and the thickness of the first holding member 2 may be set at 0.75 mm, which may be larger than the initial thickness of the TFT array substrate 61.

Although the liquid crystal cell 6 with one step has been described as a workpiece, the present invention is not limited thereto. For example, the present invention can be applied to abrading operations of workpieces without any step or with more than two steps. In this case, the number of the members comprising the work holding member for mechanical abrasion 1 will be determined as required according to the number of steps, etc. In that case, to apply Equation (1) above, the thickness of the work holding member for mechanical abrasion 1 can be set by designating the lowermost carrier as the first holding member 2, and the other carriers as the second holding member 3. Specific examples of workpieces other than the liquid crystal cell 6 include: Si wafers, polarizing glass plates, quartz glass, hard disks, etc.

As described above, the present invention allows the carrier height to be varied according to the stage of mechanical abrasion. This makes it possible to keep the clearance between the upper plate and the work holding member for mechanical abrasion within a designated range, preventing damage to the workpiece caused by the vertical displacement of the work holding member for mechanical abrasion even in the case of heavy stock removal.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A work holding member for mechanical abrasion of a workpiece, the thickness of said workpiece before and after mechanical abrasion being given by T1 and T2 respectively, the work holding member comprising:

a first holding member having formed therein a first holding hole for receiving the workpiece, where said first holding member transmits external mechanical drive force to said workpiece; and a second holding member placed on said first holding member and having formed therein a second holding hole for receiving the workpiece, wherein T1>t1+t2 and (½)T2≦t1, the thicknesses of said first holding member and said second holding member being denoted by t1 and t2 respectively.

2. The work holding member for mechanical abrasion according to claim 1, wherein said external mechanical drive force is transmitted to said second holding member through said workpiece.

3. The work holding member for mechanical abrasion according to claim 1, wherein $$T1>t1+t2>T2,$$

$$(1/2)T1 \geqq t1>(1/2)T2,$$

and $$T2>t1.$$

4. The work holding member for mechanical abrasion according to claim 1, wherein said first holding member has formed therein a plurality of holding holes.

5. A method for abrading a workpiece held between an upper plate and a lower plate, said method comprising:

a first abrading step of abrading said workpiece held by a first holding member and a second holding member disposed between the upper plate and the lower plate in the direction of the workpiece thickness; and removing one of said first holding member and said second holding member after a predetermined quantity is abraded from said workpiece; and a second abrading step of further abrading said workpiece after said removing step.

6. The method according to claim 5, wherein in said removing step one of said first holding member and said second holding member is removed and the other of said first holding member and said second holding member is not removed, and said predetermined quantity is judged based on a clearance between said upper plate and the holding member not removed in said removing step.

7. The method according to claim 5, wherein said workpiece has a step on a perimeter thereof and said first abrading step is performed with one of said first holding member and said second holding member mounted on said step.

8. The method according to claim 5, wherein said workpiece is a liquid crystal cell.

9. A method for abrading a workpiece, the method comprising:

a first abrading step of abrading said workpiece, said workpiece being held by a work carrier between an upper plate and a lower with a vertical displacement of said work carrier being subject to a restriction; and lifting said restriction on the vertical displacement of said work carrier after a predetermined quantity is abraded from said workpiece; and a second abrading step of further abrading said workpiece after said step of lifting said restriction.

10. An abrading machine, comprising:

a lower plate for mounting a workpiece;

an upper plate disposed oppositely to said lower plate;

a holding member for holding a workpiece disposed between said lower plate and said upper plate and providing driving force to said workpiece; and a spacer disposed on the holding member between said holding member and said upper plate and driven along with said workpiece, wherein a clearance between said spacer and said upper plate is not greater than a thickness of said holding member.

11. The abrading machine according to claim 10, wherein said lower plate and said upper plate are provided with an abrasive medium.

* * * * *